US009620884B2

(12) United States Patent
Borkar et al.

(10) Patent No.: US 9,620,884 B2
(45) Date of Patent: Apr. 11, 2017

(54) CONNECTOR ASSEMBLY FOR A PANEL MOUNTING SYSTEM

(71) Applicant: Appleton Grp LLC, Rosemont, IL (US)

(72) Inventors: Tushar Yadunath Borkar, Pune (IN); Vinaya Nandish Kubsad, Maharashtra (IN)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 15/014,334

(22) Filed: Feb. 3, 2016

(65) Prior Publication Data

US 2016/0233604 A1 Aug. 11, 2016

(30) Foreign Application Priority Data

Feb. 6, 2015 (IN) ..... 394/MUM/2015

(51) Int. Cl.
*H01R 13/428* (2006.01)
*H01R 13/426* (2006.01)
(Continued)

(52) U.S. Cl.
CPC ..... *H01R 13/426* (2013.01); *H01R 13/74* (2013.01); *H01R 13/533* (2013.01); *H01R 2101/00* (2013.01)

(58) Field of Classification Search
CPC ..... H01R 13/426; H01R 13/74; H01R 27/00; H01R 31/06
(Continued)

(56) References Cited

U.S. PATENT DOCUMENTS 3,144,292 A * 8/1964 Forney, Jr. ..... H01R 13/65802 439/557
3,789,346 A * 1/1974 De Brick ..... H01R 13/02 439/283
(Continued)

FOREIGN PATENT DOCUMENTS

CA 2920095 A1 * 8/2016 ..... H01R 13/426

OTHER PUBLICATIONS

Crouse-Hinds cam-lok Connectors, Roughneck High Amperage Connectors, Cooper Crouse-Hinds, 1998, 6 pages.
(Continued)

*Primary Examiner* — Hae Moon Hyeon
(74) *Attorney, Agent, or Firm* — McDonnell Boehnen Hulbert & Berghoff LLP.

(57) ABSTRACT

A customizable panel mount receptacle includes an insulator body and a contact assembly. The insulator body includes a tubular flanged element, a contact retention ring and an insulator cover over-molded on the tubular flanged element. The contact retention ring is coaxially received within the tubular flanged element and includes a plurality of apertures and a first set of engaging elements. The contact assembly includes a conductive contact and contact retention pins and a second set of engaging elements configured on conductive contact. The conductive contact is removably and co-axially received inside the male insulator body. The contact retention pins engage with the apertures configured on the contact retention ring and the second set of engaging elements engage with the first set of engaging elements for facilitating interchangeable connections between different configurations of the male insulator body and the male contact assembly to reduce inventory.

9 Claims, 8 Drawing Sheets

(51) Int. Cl.

| | |
|---|---|
| ***H01R 13/74*** | (2006.01) |
| *H01R 13/533* | (2006.01) |
| *H01R 101/00* | (2006.01) |

(58) Field of Classification Search
USPC ..... 439/744, 745, 953, 518
See application file for complete search history.

(56) References Cited

U.S. PATENT DOCUMENTS

| | | | | |
|---|---|---|---|---|
| 5,575,691 | A * | 11/1996 | Matthews | H01R 43/22 439/744 |
| 6,299,491 | B1 * | 10/2001 | Bruce | H01R 13/426 439/744 |
| 6,945,795 | B1 * | 9/2005 | Gross, III | H01R 23/6873 439/63 |
| 7,172,467 | B1 * | 2/2007 | Yohn | H01R 13/64 439/686 |
| 7,442,096 | B1 * | 10/2008 | Gilliam | H01R 13/44 439/149 |
| 7,736,199 | B2 * | 6/2010 | Cossette | H01R 13/426 439/745 |
| 8,961,205 | B2 * | 2/2015 | Sandwith | H01R 13/53 439/149 |
| 9,437,952 | B2 * | 9/2016 | Borkar | H01R 13/42 |
| 2015/0214660 | A1 * | 7/2015 | Sandwith | H01R 13/187 439/345 |

OTHER PUBLICATIONS

Leviton, "Rhino-Hide 49 Series Connectors Product Bulletin," Leviton Manufacturing Co., Inc., 2006, 8 pages.
RigPower, LLC, RigPower RMP II Series, Catalog, pre-2016, 8 pages.

* cited by examiner

CONNECTOR ASSEMBLY FOR A PANEL MOUNTING SYSTEM

RELATED APPLICATIONS

This application claims priority to Indian Application No. 394/MUM/2015 filed Feb. 6, 2015, entitled "A CONNECTOR ASSEMBLY FOR A PANEL MOUNTING SYSTEM."

FIELD OF THE DISCLOSURE

The present disclosure relates to a connector assembly, particularly, the present disclosure relates to a customizable panel mount male and female receptacle of a connector assembly that reduces inventory requirement.

BACKGROUND

The panel mount receptacles are used on a power side of a circuit for connection to a portable cable. The panel mount receptacles are used in various industrial applications, for example, electrical connectors are used for connecting electrical elements used for continuous transmission of power. Typical applications are the transmission of power from generator sets to switchgear or Silicon Controlled Rectifiers (SCR) controls, from the control house to the traction motors, mud pumps, draw works, rotary tables, cement pumps and top drives via connectors. Generally, the traditional design of the panel mount receptacle is such that the electrical contacts are shrouded by rubber insulators. The male receptacle includes a conductive male contact pin shrouded by a rubber insulator body, wherein the rubber insulator body is integrally formed on the conductive male contact pin and a female receptacle includes a conductive female contact sleeve shrouded by a rubber insulator body and receptacle housing, wherein the insulator body is integrally formed on the conductive female contact sleeve. More specifically, the male receptacle includes a conductive male pin contact at a front and the base portion for electrical wire termination or connection, with an insulated cover body integrally formed over the conductive male pin contact. The female receptacle includes a conductive female sleeve contact at a front and the base portion for electrical wire termination or connection, with an insulated cover body integrally formed on the conductive female sleeve contact. The male panel mount receptacles are used on the power side of the circuits for connection to cable mount female plugs. The female panel mount receptacles are used on the machine or motor side of the circuit for connection to cable mounted male plugs. More specifically, the electrical connector assembly is used for connecting an electrical cable on a machine side to a fixed mating connector on a panel side. Certain electrical connectors are configured specifically to cater to the drilling rig industry. These connectors, particularly, single pole electrical connectors are configured for applications where the connectors are required to operate in the most extreme service conditions and are subjected to very high currents in excess of 1,000 Amps.

The field assembly and the installation of many inland drilling rigs have led to widespread use of a single pole electrical connector assembly that can be prepared in the field. These connector assemblies may take different forms, including a pin and collet style connector assembly or a plug and receptacle type connector assembly. One preferred configuration, particularly, the plug and the receptacle type connector assembly include a panel mount and cable-end connectors connected with male or female connector sub-assemblies. The male and female connector sub-assemblies of the conventional plug and receptacle type connector assembly includes overmolding of the insulator body over the engaging electrical contact elements, particularly, over the conductive male pin contact and the conductive female sleeve contact of the respective male connector sub-assembly and the female connector sub-assembly. In case of the conventional connector assembly, the overmolding of the insulator body over the conductive male pin contact and the conductive female sleeve contact are integrally configured thereon, and as such there is no chance of customization of the conductive male pin contact and the conductive female sleeve contact.

The panel mount receptacle has different configurations and may vary based on termination style single or double hole, type of cable sizes to be used, and color coding to prevent cross polarization and male or female connector. Due to this inherent nature of the above requirements, the manufacturer needs to keep an inventory of approximately 160 different types of engaging copper connector elements, male or female connector sub-assemblies, particularly, 160 different types of panel mount receptacles are required to be maintained and the manufacturer needs to maintain 160 different types of the panel mount receptacles in the inventory in order to serve a particular customer order. The prior art receptacle has a disadvantage of requiring a supplier to maintain a huge inventory of engaging copper connector elements. However, with such varying customer requirements, a large inventory of different elements, particularly, different configurations of conductive male pin contacts and the conductive female sleeve contacts of the panel mount receptacle connector assembly is difficult to maintain.

Accordingly, there is a need for a customizable panel mount receptacle that can be customized based on customer requirement while still not requiring a large inventory of the panel mount receptacle.

OBJECTS

Some of the objects of the present disclosure aimed to ameliorate one or more problems of the prior art or to at least provide a useful alternative are listed herein below.

An object of the present disclosure is to provide a connector assembly having either a customizable panel mount male or female receptacle, wherein the panel mount male receptacle and panel mount female receptacle can be customized based on customer requirements while still not requiring a large inventory of conductive contacts.

Another object of the present disclosure is to provide a customizable panel mount receptacle that substantially reduces the inventory costs.

Another object of the present disclosure is to provide a customizable panel mount receptacle that has a modular configuration.

Still another object of the present disclosure is to provide a customizable panel mount receptacle that can quickly change configurations based on customer requirements.

Still another object of the present disclosure is to provide a customizable panel mount receptacle that is simple in construction and convenient to use.

Another object of the present disclosure is to provide a customizable panel mount receptacle that is reliable.

Yet another object of the present disclosure is to provide a customizable panel mount receptacle that eases inventory management.

Another object of the present disclosure is to provide a customizable panel mount receptacle that requires minimum maintenance.

Other objects and advantages of the present disclosure will be more apparent from the following description when read in conjunction with the accompanying figures, which are not intended to limit the scope of the present disclosure.

SUMMARY

A customizable panel mount male receptacle includes a male insulator body and a male contact assembly. The male insulator body includes a tubular flanged element, a contact retention ring and a male insulator cover over-molded on the tubular flanged element. The contact retention ring is co-axially received within the tubular flanged element and includes a plurality of apertures and a first set of engaging elements configured thereon. The male contact assembly includes a conductive male contact pin and a plurality of contact retention pins and a second set of engaging elements. The conductive male contact pin is removably and co-axially received inside the male insulator body. The plurality of contact retention pins and the second set of engaging elements are configured on the conductive male contact pin, wherein the contact retention pins engage with the apertures configured on the contact retention ring and the second set of engaging elements engage with the first set of engaging elements for facilitating interchangeable connections between different configurations of the male insulator body and the male contact assembly, wherein interchangeable connections between different configurations of the male insulator cover of male insulator body and the conductive male contact pin of the male contact assembly facilitates customization of the panel mount male receptacle based on a requirement to reduce inventory.

A customizable panel mount female receptacle is disclosed in accordance with an embodiment of the present disclosure. The customizable panel mount female receptacle includes a female insulator body and a female contact assembly. The female insulator body includes a tubular flanged element, a contact retention ring and a female insulator cover over-molded on said tubular flanged element. The contact retention ring is co-axially received within the tubular flanged element and includes a plurality of apertures and a first set of engaging elements configured thereon. The female contact assembly includes a conductive female contact sleeve and a plurality of contact retention pins and a second set of engaging elements. The conductive female contact sleeve is removably and co-axially received inside the female insulator body. The plurality of contact retention pins and the second set of engaging elements are configured on the conductive female contact sleeve, wherein the contact retention pins engage with the apertures configured on the contact retention ring and the second set of engaging elements engage with the first set of engaging elements to facilitate interchangeable connections between different configurations of the female insulator body and the female contact assembly, wherein interchangeable connections between different configurations of the female insulator cover of the female insulator body and the conductive female contact sleeve of the female contact assembly facilitate customization of the panel mount female receptacle based on requirements to reduce inventory.

Typically, the customizable panel mount male receptacle is mounted on a power side of a circuit and is releasably connected to a cable mounted female plug assembly on a machine side.

Generally, the customizable panel mount female receptacle is mounted on a power side of a circuit and is releasably connected to a cable mounted male plug assembly on a machine side.

Alternatively, the customizable female panel mount receptacles are mounted on either one of the machine and motor side of the circuit for connection to cable mounted male plug assemblies.

Generally, the first set of engaging elements of the customizable panel mount male receptacle are receiving slots configured on an inside surface of the contact retention ring of the male insulator body and the second set of engaging elements are contact retention spring elements configured on a contact retention spring mounted on the conductive male contact pin, wherein the contact retention spring elements engage with said receiving slots.

Alternatively, the first set of engaging elements of the customizable panel mount female receptacle are receiving slots configured on an inside surface of the contact retention ring of the female insulator body and the second set of engaging elements are contact retention spring elements configured on a contact retention spring mounted on the conductive female contact sleeve, wherein the contact retention spring elements engages with the receiving slots.

Typically, the first set of engaging elements of the customizable panel mount male receptacle are U-slots configured on the contact retention ring of the male insulator body and the second set of engaging elements are spring biased pins configured on said conductive male contact pin, wherein the spring biased pins engage with the U-slots.

Alternatively, the first set of engaging elements of the customizable panel mount male receptacle are a first set of guide-ways configured on the contact retention ring of the male insulator body and the second set of engaging elements are a second set of guide-ways configured on the conductive male contact pin that are complimentary to and that engage with the first set of guide ways.

BRIEF DESCRIPTION

The customizable panel mount receptacle of the present disclosure will now be described with the help of the accompanying drawings, in which.

Figure 4A:
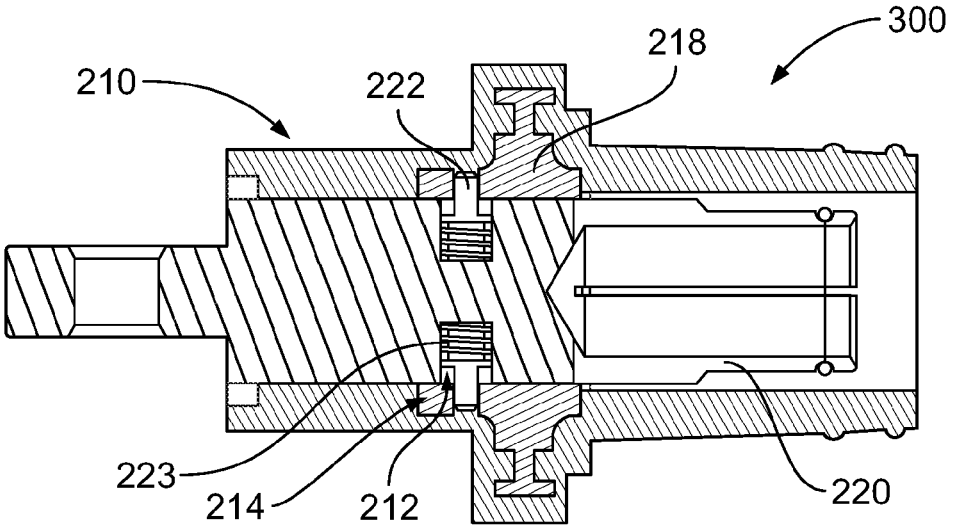
Figure 4B:
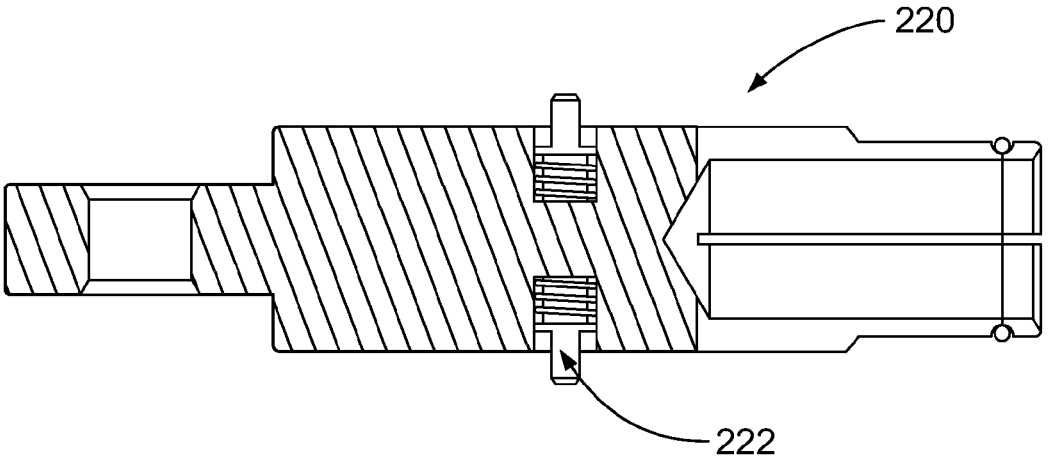
Figure 4C:
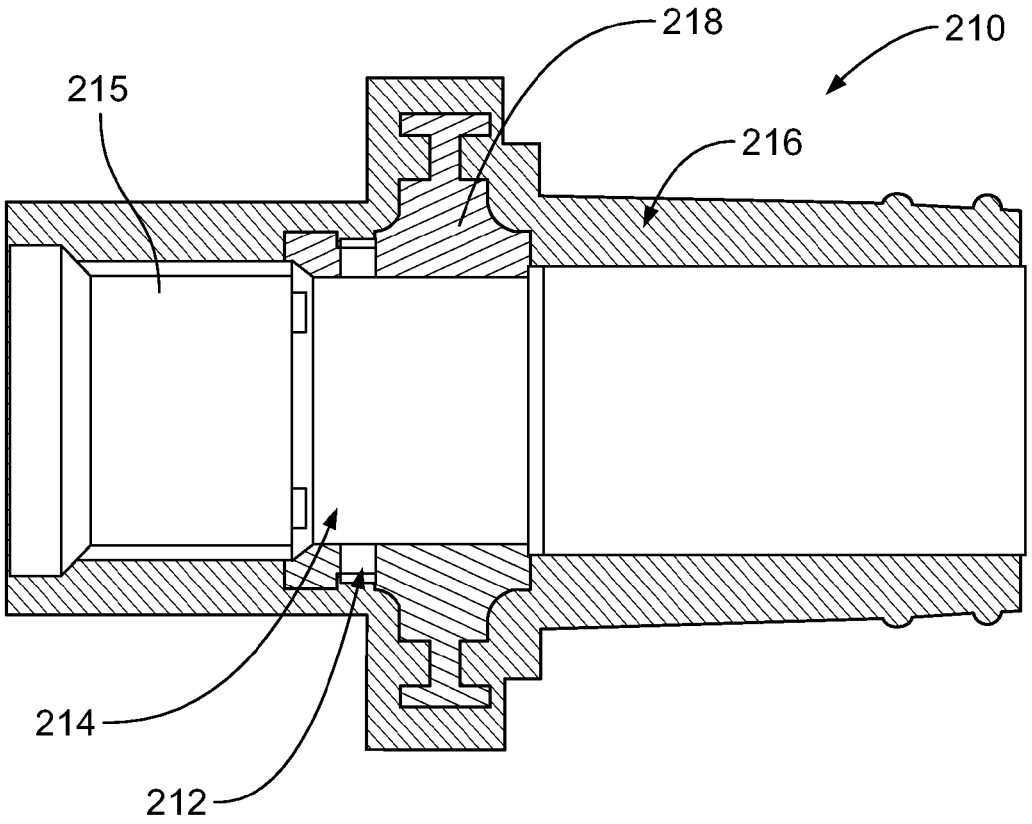
Figure 5A:
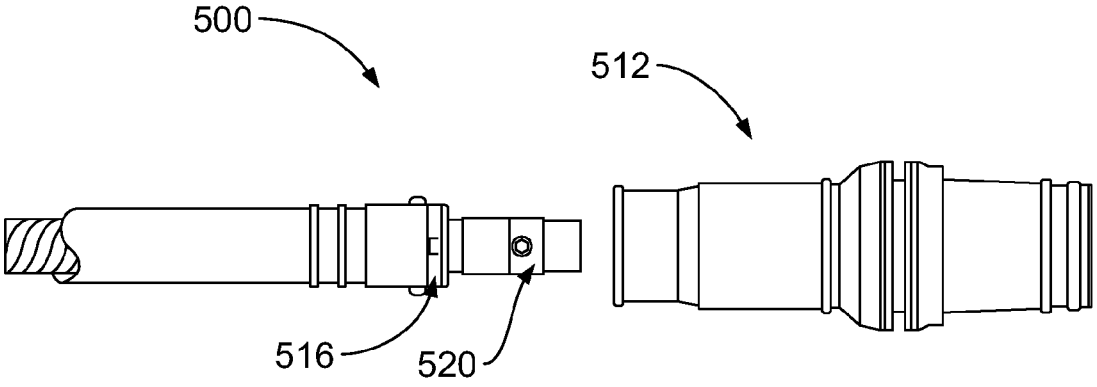
Figure 5B:
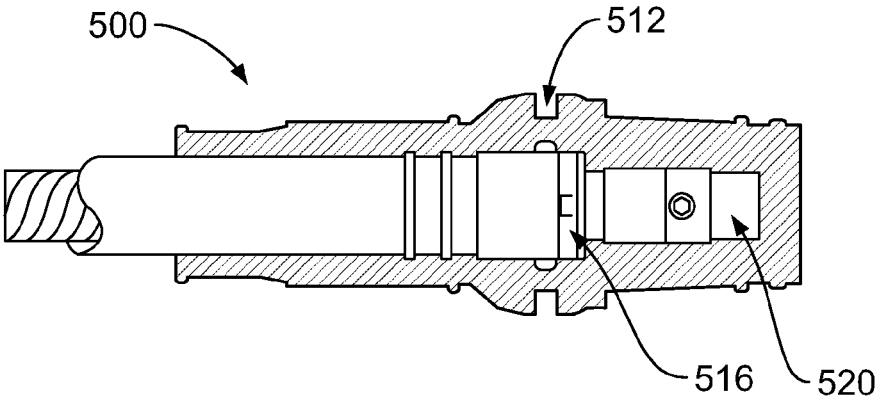
Figure 6A:
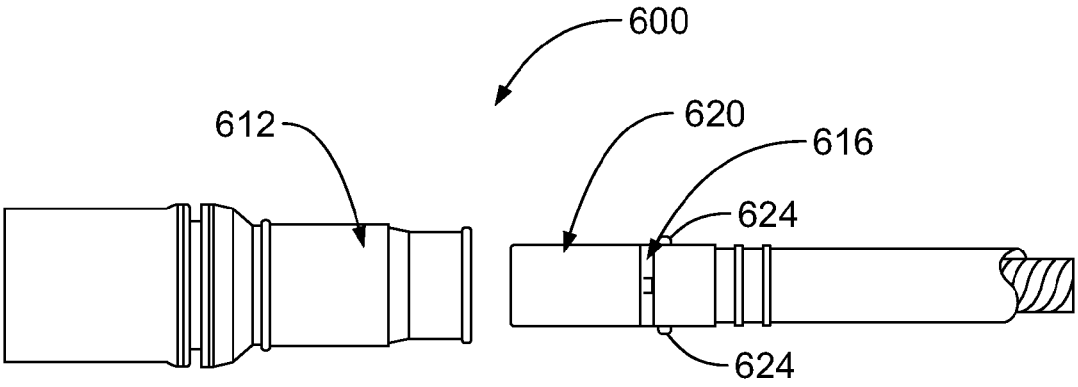
Figure 6B:
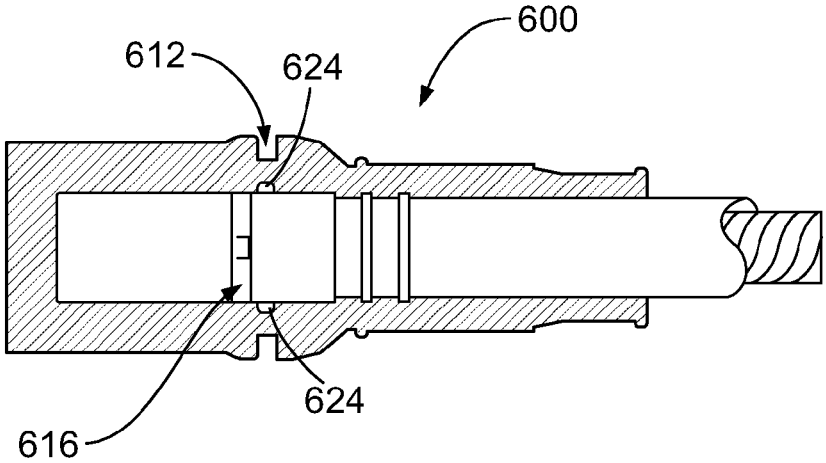
Figure 7A:
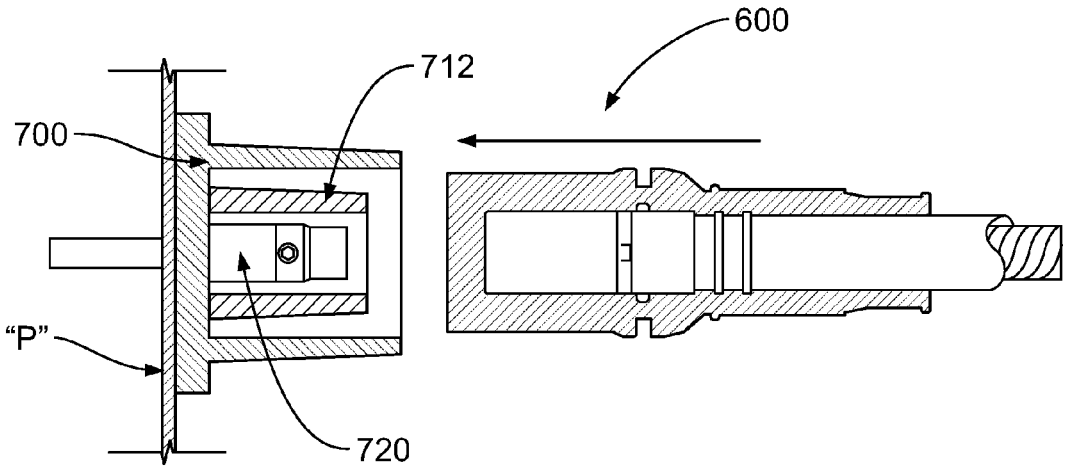
Figure 7B:
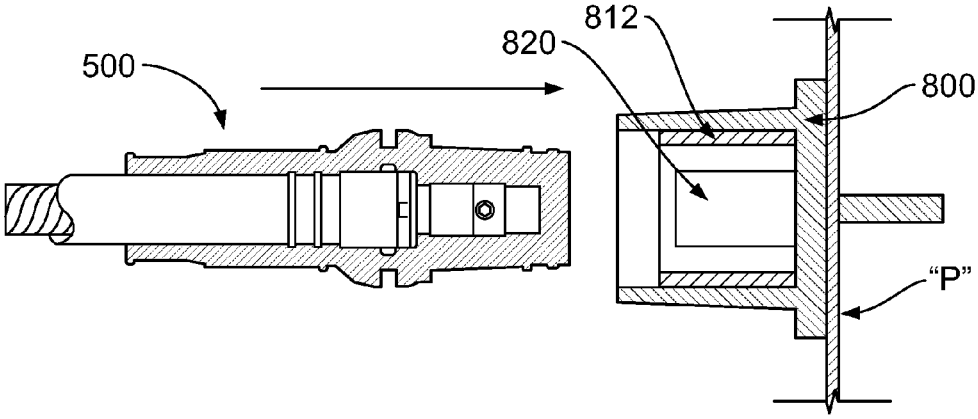

FIG. 4A illustrates a schematic representation of a panel mount male receptacle in accordance with another embodiment of the present disclosure, wherein a conductive male pin contact includes spring biased pin elements that are urged to engage and are received within corresponding receiving slots/holes configured on an inner wall of a contact retention ring that is received within a tubular flanged element or a flange shaped part;

FIG. 4B illustrates a sectional view of the conductive male pin contact of FIG. 4A with the spring biased pin elements configured thereon;

FIG. 4C illustrates a sectional view of the male insulator body of FIG. 4A;

FIG. 5A illustrates a customizable panel mount male plug on the power side in accordance with an embodiment mounted on a power side of a circuit and illustrated in dis-assembled configuration, wherein the male insulator cover body is dis-assembled from the conductive male pin contact;

FIG. 5B illustrates the customizable panel mount male plug on the power side of FIG. 5A in an assembled configuration;

FIG. 6A illustrates customizable female plug on the machine side in accordance with another embodiment mounted on a power side of a circuit and illustrated in dis-assembled configuration, wherein the female insulator cover body is dis-assembled from the conductive female sleeve contact;

FIG. 6B illustrates the customizable female plug on the machine side of FIG. 6A in an assembled configuration;

FIG. 7A illustrates a customizable panel mount male receptacle in accordance with an embodiment mounted on a power side of a circuit that engages with the customizable female plug on the machine side as illustrated in FIG. 6B; and FIG. 7B illustrates a customizable panel mount female receptacle in accordance with another embodiment mounted on a power side of a circuit that engages with the customizable male plug on the power side as illustrated in FIG. 5B.

DETAILED DESCRIPTION

The customizable panel mount male and female receptacle of the present disclosure will now be described with reference to the embodiments shown in the accompanying drawings. The embodiments do not limit the scope and ambit of the disclosure. The description relates purely to the examples and preferred embodiments of the disclosed devices and their suggested applications.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The present disclosure envisages customizable panel mount male and female receptacles. More specifically, the present disclosure envisages a customizable panel mount receptacle, wherein either panel mount receptacles can be customized based on customer requirements while still not requiring maintaining of a large inventory of different configurations of male or female panel mount receptacles. The male receptacle includes a conductive male pin contact at a front and the base portion for electrical wire termination or connection, with a male insulator body removably assembled over the conductive male pin contact. The female receptacle includes a conductive female sleeve contact at a front and the base portion for electrical wire termination or connection, with a female insulated body removably assembled on the conductive female sleeve contact. The male insulator body includes a tubular flanged element also referred to as a flanged shaped plastic part with a contact retention ring press fitted into it and a rubber cover overmolded over the flanged shaped plastic part. The contact retention ring includes a plurality of apertures and a first set of engaging elements configured thereon. In accordance with an embodiment the first set of engaging elements are receiving slots configured on the contact retention ring. In accordance with another embodiment the first set of engaging elements are U slots configured on the contact retention ring. In accordance with still another embodiment the first set of engaging elements are a first set of guide-ways configured on the contact retention ring. The male contact assembly includes a conductive male pin contact and a plurality of contact retention pins and a second set of engaging elements. In accordance with one embodiment, the second set of engaging elements are contact retention spring elements configured on a contact retention spring mounted on the conductive male contact pin, wherein the contact retention spring elements engage with the receiving slots configured on an inner wall of the contact retention ring received in the tubular flanged element. In accordance with another embodiment the second set of engaging elements are spring biased pins configured on the conductive male contact pin, wherein the spring biased pins engage with the U-slots configured on the contact retention ring. In accordance with still another embodiment, the second set of engaging elements are a second set of guide-ways configured on the conductive male contact pin that engage with the first set of guide ways. Such a configuration provides modularity to the panel mount receptacle, particularly, the conductive male contact pin is removably and co-axially received inside the male insulator body and the panel mount receptacle becomes customizable as per customer requirements and so there is no need to maintain a large inventory of conductive male contact pin of different configurations.

Figure 1A:
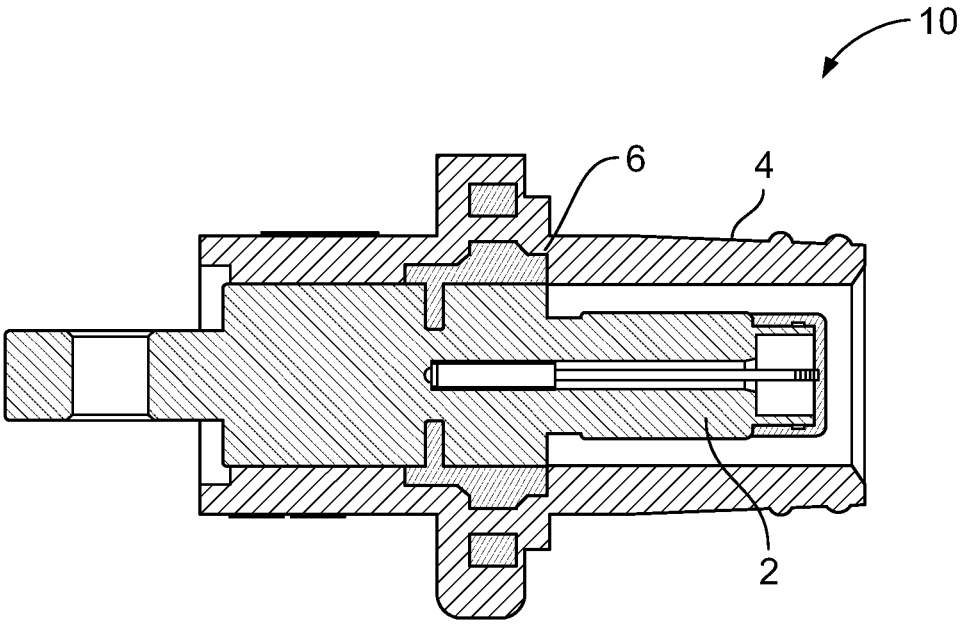
FIG. 1A (Prior Art)
FIG. 1A illustrates a schematic representation of a panel mount male receptacle in accordance with the prior art, wherein the male contact assembly is shrouded by an insulator cover that is integrally formed on the male contact assembly.

FIG. 1A illustrates a schematic representation of a panel mount receptacle 10 in accordance with the prior art, wherein an insulated cover body 4 is overmolded over and is integral with a conductive male pin contact 2 with a plastic insert 6 disposed between the conductive male pin contact 2 and the insulated cover body 4. More specifically, FIG. 1*a* illustrates the panel mount receptacle 10 in accordance with the prior art.

Figure 1B:
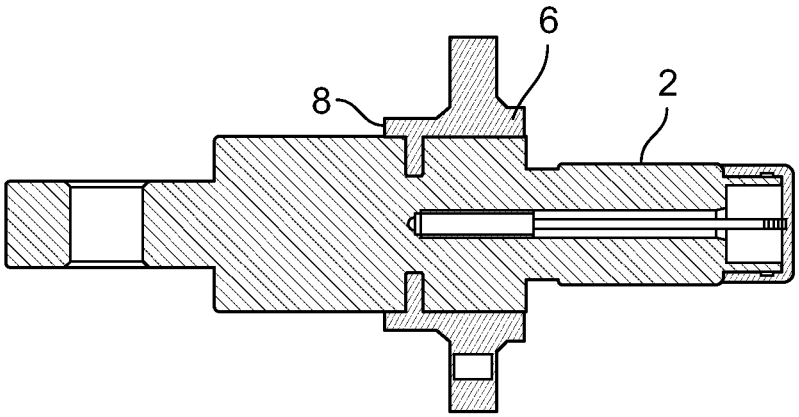
FIG. 1B (Prior Art)
FIG. 1B illustrates a schematic representation of the male contact assembly of FIG. 1A, wherein the male contact assembly includes a plastic insert and a dowel spring element.

FIG. 1B illustrates a schematic representation of the conductive male pin contact 2, wherein the conductive male pin contact 2 includes a plastic insert 6 and a dowel spring element 8. The panel mount receptacle 10 forms a part of different configurations of connector assemblies, including a pin and collet style connector assembly or a plug and receptacle type connector assembly. One preferred configuration of a connector assembly, particularly, the plug and receptacle type connector assembly are configured by assembling the panel mount receptacle as illustrated in FIG. 1A and a cable-end connector (not illustrated in Figures). The panel mount receptacle 10 includes the conductive male pin contact 2 and the first insulated cover body 4. The conductive male pin contact 2 is received inside the first insulated cover body 4. More specifically, the panel mount receptacle 10 of the conventional plug and receptacle type connector assembly includes overmolding of the insulator body over the electrical connector element, particularly, over the conductive male pin contact 2. The overmolding insulated cover body 4 is an integral part of the conductive male pin contact 2 and there is no provision for customization of the panel mount receptacle 10 based on different configurations of the conductive male pin contact 2 and accordingly, a large inventory of the panel mount receptacles 10 is required to be maintained. Particularly, due to inherent configurations of the conventional panel mount receptacles an inventory of approximately 160 different types of engaging copper connector elements, particularly, 160 different types of panel mount receptacles are required to be maintained and the manufacturer needs to maintain 160 different types of the panel mount receptacles in the inventory in order to serve a particular customer order. The prior art receptacle has a disadvantage of requiring a supplier to maintain a huge inventory of engaging copper connector elements.

Figure 2A:
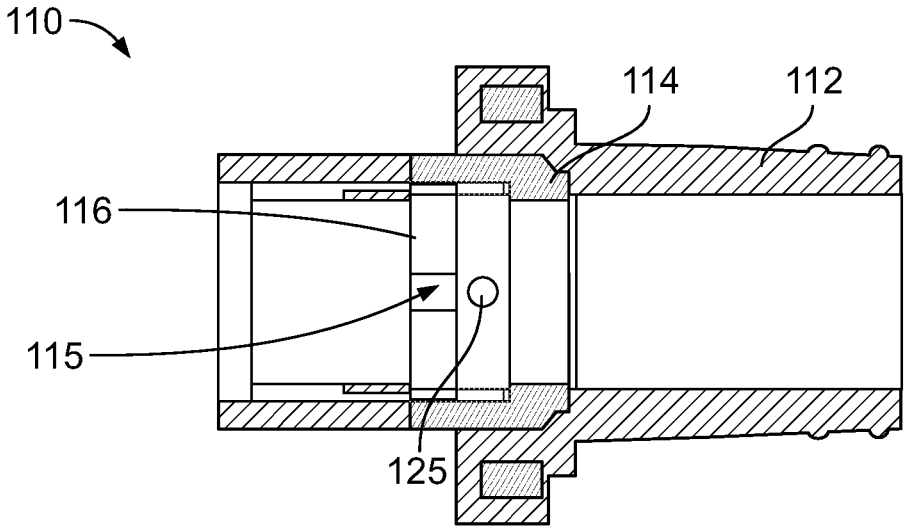
FIG. 2A illustrates a schematic representation of a male insulator body of a male connector sub-assembly of a panel mount male receptacle in accordance with an embodiment of the present disclosure, wherein a contact retention ring is press fitted inside a tubular flanged element referred to as a flange shaped plastic part and a male insulator cover is over-molded on the tubular flanged element.
Figure 2B:
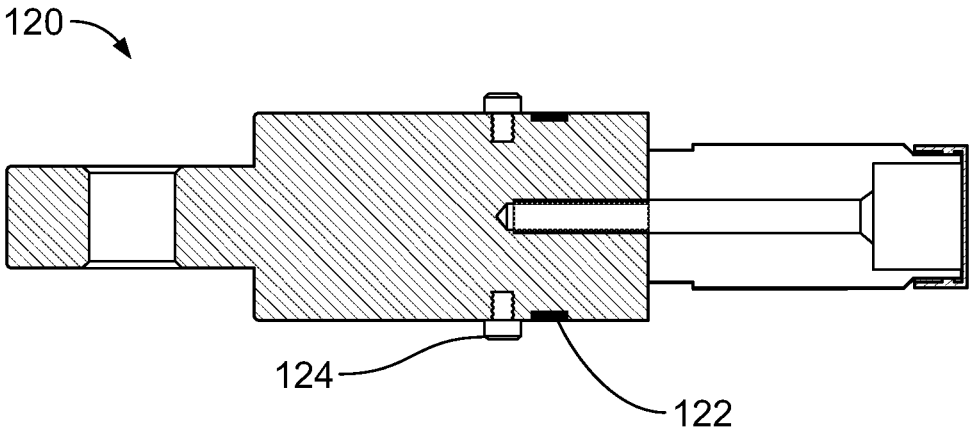
FIG. 2B illustrates a schematic representation of a male contact assembly in accordance with an embodiment of the present disclosure, wherein a conductive male contact pin includes a plurality of contact retention pins and a second set of engaging elements configured thereon.
Figure 3A:
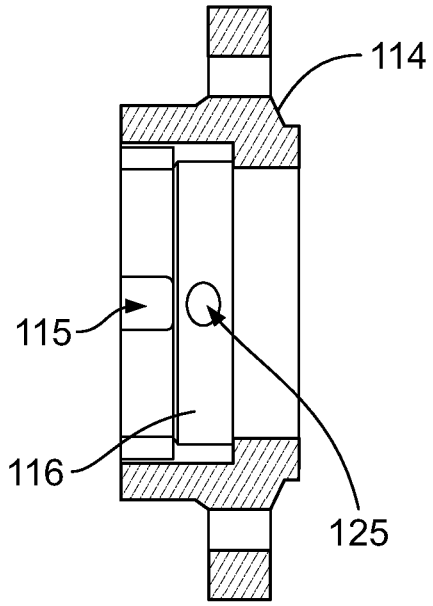
FIG. 3A illustrates a cross-sectional view of the tubular flanged element or the flange shaped body of FIG. 2A with the contact retention ring received therein.
Figure 3B:
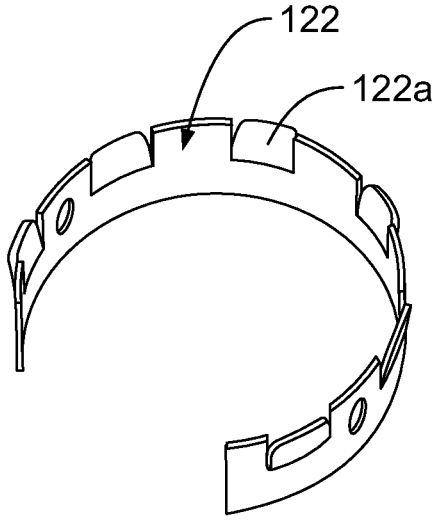
FIG. 3B illustrates an isometric view of the contact retention spring with contact retention spring elements of FIG. 2B configured thereon.

FIG. 2A illustrates a schematic representation of a male insulator body 110 for removably receiving a conductive male contact pin 120 (illustrated in FIG. 2B) of a panel mount receptacle in accordance with an embodiment of the present disclosure. The male insulator body 110 includes a resilient, insulator cover body also referred to as a male insulator cover body 112, a tubular flanged element 114 and a contact retention ring 116, wherein the resilient, male insulator cover body 112 is over-molded over the tubular flanged element 114 that in turn receives the contact retention ring 116 therein and the contact retention ring 116 removably receives the conductive male contact pin 120. In accordance with an embodiment, the contact retention ring 116 is of brass material. The contact retention ring 116 includes a first set of engaging elements, particularly U-slots 115 (illustrated in FIG. 3A) or a plurality of receiving slots 117 (illustrated in FIG. 3C) configured thereon, particularly, the plurality of receiving slots 117 are configured on an inner wall of the contact retention ring 116. The U-slots 115 are configured on the contact retention ring 116. In accordance with another embodiment, the engaging elements are guide-ways configured on the contact retention ring 116. The resilient, male insulator cover body 112 is overmolded over the tubular flanged element 114 that in turn receives the contact retention ring 116 therein and the contact retention ring 116 removably receives the conductive male contact pin 120 that has a contact retention spring 122 mounted thereon, thereby facilitating customization of the panel mount male receptacle based on different customer requirements to reduce inventory. More specifically, in case the panel mount receptacle is of a first configuration/type/kind, a conductive male contact pin is received within the contact retention ring 116 of a corresponding insulator cover body with the tubular flanged element 114 and in case the panel mount male receptacle is of a second configuration/type/kind, the earlier insulator cover body is removed and is replaced with removable, replaceable cover body corresponding to the second type of panel mount male receptacle. With such a configuration, the removable cover body can be used for configuring different configurations of the panel mount receptacle and there is no need to maintain a large inventory of panel mount male receptacles for different configurations of the panel mount male receptacles. The tubular flanged element 114 urges the contact retention ring 116 towards the conductive male contact pin 120 that has the contact retention spring 122 mounted thereon to facilitate a tight fit between the contact retention ring 116 and the conductive male pin contact pin 120. The contact retention ring 116 receives the contact retention spring 122 mounted on the conductive male contact pin 120. Further, the contact retention spring 122 has a plurality of contact retention spring elements 122*a* configured thereon. The contact retention spring elements 122*a* engage with and are received within the receiving slots 117 configured on an inside wall surface of the contact retention ring 116. FIG. 3A illustrates a side view of tubular flanged element 114 with the contact retention ring 116 received within the tubular flanged element 114. FIG. 3B illustrates an isometric view of the contact retention spring 122 with the plurality of contact retention spring elements 122*a* configured thereon.

Figure 3C:
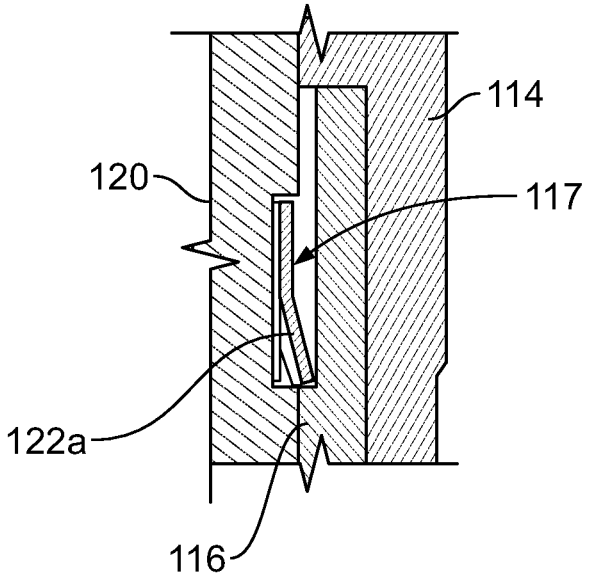
FIG. 3C illustrates a schematic representation depicting interaction between a contact retention spring element of the contact retention spring mounted on the conductive male pin contact of FIG. 2B and a receiving slot configured on the inner wall of said contact retention ring of FIG. 3B.

Again referring to FIG. 2B, FIG. 2B illustrates a schematic representation of the male contact assembly that includes the conductive male contact pin 120 having a plurality of contact retention pins 124 and a second set of engaging elements, particularly contact retention spring 122 configured thereon. The contact retention spring 122 in turn includes the plurality of contact retention spring elements 122*a*. The conductive male contact pin 120 is coaxially, removably received within the male insulator body 110, particularly, within the contact retention ring 116 that is received within the male insulator cover body 112. The conductive male pin contact pin 120 includes at least one second set of engaging elements such as contact retention spring 122 (illustrated in FIG. 2B and 3C). More specifically, the conductive male contact pin 120 is coaxially, removably received within the contact retention ring 116 that in turn is received within the male insulator cover body 112. In accordance with one embodiment, the second set of engaging elements are contact retention spring 122 configured on the conductive male contact pin 120, wherein the plurality of contact retention spring elements 122*a* of the contact retention spring 122 engage with the receiving slots 117 configured on an inner wall of the contact retention ring 116 received in the tubular flanged element 114 as illustrated in FIG. 3C. In accordance with another embodiment the second set of engaging elements are spring biased pins configured on the conductive male contact pin 120, wherein the spring biased pins engage with the U-slots 115 configured on the contact retention ring 116. In accordance with still another embodiment, the second set of engaging elements are a second set of guide-ways configured on a conductive male pin contact 220 that engage with a first set of guide-ways 215. In accordance with an embodiment the contact retention pins 124 that are configured on the conductive male contact pin 120, the contact retention pins 124 are received within the U-slots 115 configured on the contact retention ring 116 to facilitate aligning of the conductive male contact pin 120 with respect to the male insulator cover body 112. The plurality of contact retention spring elements 122*a* are disposed along the periphery of the contact retention spring 122 mounted on the conductive male contact pin 120 and engage with the receiving slots 117 configured on the inner wall surface of the contact retention ring 116 that is received within the male insulator cover body 112 to facilitate spring biased engagement between the conductive male contact pin 120 and the male insulator cover body 112. FIG. 3C illustrates a schematic representation depicting interaction between the contact retention spring elements 122*a* of the contact retention spring 122 mounted on the conductive male pin contact pin 120 and the receiving slot 117 configured on the inner wall of the contact retention ring 116 that is received within the male insulator cover body 112. Such configuration of the engagement between the first set of engaging elements configured on the contact retention ring 116 and the second set of engaging elements configured on the conductive male contact pin 120 prevents relative rotational movement between the male insulator body 110 and the male contact assembly. Particularly, the contact retention spring elements 122*a*, spring biased pins and guide-ways configured on the conductive male contact pin 120 respectively engage with the receiving slots 117, the U-slots 115 and complimentary guide-ways configured on the contact retention ring 116 received in the male insulator body to facilitate engagement between the male insulator body 110 and the conductive male contact pin 120. Further, the apertures 125 (shown in FIGS. 2A and 3A) configured on the contact retention ring 116 receive contact retention pins of conductive male contact pin 120. Such a configuration prevents relative axial movement between the movement between the male insulator body 110 and the male contact assembly. More specifically, male insulator cover body 112 molded in plastic is removably and replaceably mounted over the tubular flanged element 114 and the contact retention ring 116 received within the tubular flanged element 114, as shown in FIG. 2A. The conductive male contact pin 120 has contact retention pins 124 configured thereon to be aligned with the U-slots 115 configured on the contact retention ring 116 disposed inside the tubular flanged element 114. When inserted correctly, the contact retention spring elements 122*a* of the contact retention spring 122 locks with the receiving slots 117 configured behind the contact retention ring 116 to hold the assembly of the conductive male pin contact pin 120 and the male insulator cover body 112 in position as shown in FIG. 3C. Accordingly, male insulator cover body 112 can be changed based upon customer requirements and with such configuration a manufacturer can maintain only 20 copper terminals/conductive contacts and 20 male insulator cover body 112, in 10 different colors, thereby reducing the inventory for copper connectors from 50 to 20 as the male insulator cover body 112 and terminal assembly/conductive contact assembly are separate items, a manufacturer can make assembly of a receptacle per the customer order with keeping only 20 copper terminals and 20 insulator bodies in inventory. Accordingly, with such configuration, the inventory of copper terminals panel mount receptacles is reduced. More specifically for example if a supplier gets following order:

10 panel mount male receptacles with the male insulator cover having a red color and a conductive contact having single hole;

10 panel mount male receptacles with the male insulator cover having a blue color and a conductive contact having single hole;

10 panel mount male receptacles with the male insulator cover having a green color and a conductive contact having single hole;

20 panel mount male receptacles with the male insulator cover having a red color and a conductive contact having double hole;

20 panel mount male receptacles with the male insulator cover having a blue color and a conductive contact having double hole;

20 panel mount male receptacles with the male insulator cover having a green color and a conductive contact having double hole;

In case of conventional panel mount male receptacle that is not customizable, all the 90 panel mount male receptacles are to be manufactured as one piece at a time requiring a large inventory of the conductive contact elements. However, in the case of the customizable panel mount male receptacle in accordance with the present disclosure, the male insulator body and the male contact assembly can be manufactured separately and assembled to configure the customizable panel mount male receptacle as such conductive contacts of different configurations can be manufactured based on customer requirements and assembled to any configuration of the male insulator body for example if the supplier has to first deliver a lot of 10 panel mount male receptacles with the male insulator cover having a red color and a conductive contact having single hole, the supplier just has to assemble the already manufactured male insulator cover having a red color with freshly manufactured conductive contacts having single hole, accordingly, with such configuration of the customizable panel mount male receptacle considerably reducing of the inventory of the conductive contacts is achieved. Further, the customizable panel mount male receptacle can be assembled at the supplier end to reduce inventory and facilitate inventory management at supplier's end and reaches the customer in an assembled configuration.

FIG. 4A illustrates a schematic representation of panel mount male receptacle 300 for a connector assembly in accordance with another embodiment of the present disclosure, wherein the conductive male pin contact 220 as illustrated in FIG. 4B includes spring loaded locking pins 222 that are urged radially outwards by a spring 223 to engage and be received within corresponding receiving slots 212 (illustrated in FIG. 4A and FIG. 4C) configured on an inner wall of a contact retention ring 214 that is received within a male insulated cover body 210. FIG. 4B illustrates a sectional view of the conductive male pin contact 220. FIG. 4C illustrates a sectional view of the male insulator cover body 210.

The conductive male pin contact 220 has two diametrically opposite spring loaded locking pins 222. Although, the conductive male pin contact 220 illustrated in FIG. 4B illustrates only two diametrically opposite spring loaded locking pins 222 configured thereon. However, configuration of the spring loaded locking pins 222 configured on the conductive male pin contact 220, i.e. the placement and number of the spring loaded locking pins 222 is not limited to the configuration illustrated in FIG. 4B. The spring loaded locking pins 222 should be pressed into the receiving slots 212 configured on the contact retention ring 214 that is received within the male insulated cover body 210. When assembled, the spring loaded locking pins 222 configured on the conductive male pin contact 220 lock into the receiving slots 212 that are configured on an inner wall of the contact retention ring 214 that in turn is received within the male insulator cover body 210. The male insulator cover body 210 facilitates radial pressing of a tubular flanged element 218 received therein towards the contact retention ring 214 to facilitate tight fit between the contact retention ring 214 and the conductive male pin contact 220, thereby facilitating removable engagement between the conductive male pin contact 220 and the male insulator cover body 210. The contact retention ring 214 further includes the first set of guide-ways 215 (illustrated in FIG. 4C) that engage with complimentary guide-ways configured on the conductive male pin contact 220 to facilitate aligned connection between the conductive male pin contact 220 and the male insulated cover body 210. The male insulated cover body 210 has a tubular configuration. The male insulated cover body 210 includes a resilient, a cover element 216 or male insulator cover, the contact retention ring 214 and the tubular flanged element 218. The contact retention ring 214 includes at least one first set of engaging elements, particularly the first set of guide-ways 215 configured thereon and the receiving slots 212 configured on an inner wall of the contact retention ring 214. The tubular flanged element 218 is disposed within at least a portion of the cover element 216 and radially presses the inner wall of the contact retention ring 214 radially inwards toward the conductive male pin contact 220 of the panel mount male receptacle 300.

FIG. 5A illustrates a customizable cable mounted male plug 500 mounted on a power side of a circuit and is illustrated in dis-assembled configuration, wherein a male insulator cover body 512 is dis-assembled from the conductive male pin contact 520 and assembly between the male insulator cover body 512 and the conductive male pin contact 520 is via a contact retention ring 516, wherein for sake of clarity of the assembly between the male insulator cover body 512 and the conductive male pin contact 520, the contact retention ring 516 is shown disposed on the conductive male pin contact 520, however, actually, the contact retention ring 516 is received with the male insulator cover body 512 and the contact retention ring 516 receives the conductive male pin contact 520 for facilitating removable connection of the conductive male pin contact 520 within the male insulator cover body 512. FIG. 5B illustrates the customizable cable mounted male plug 500 in an assembled configuration.

FIG. 6A illustrates a customizable female plug 600 mounted on a power side of a circuit and is illustrated in dis-assembled configuration, wherein the female insulator cover body 612 is dis-assembled from the conductive female sleeve contact 620 and assembly between the female insulator cover body 612 and the conductive female sleeve contact 620 is via a contact retention ring 616, wherein for sake of clarity of the assembly between a female insulator cover body 612 and the conductive female sleeve contact 620, the contact retention ring 616 is shown disposed on the conductive female sleeve contact 620, however, actually, the contact retention ring 616 is received with the female insulator cover body 612 and the contact retention ring 616 receives the conductive female sleeve contact 620 for facilitating removable connection of the conductive female sleeve contact 620 within the female insulator cover body 612. FIG. 6B illustrates the customizable female plug 600 in an assembled configuration. As noted above on page 6, the female insulator body may include a tubular flanged element and a contact retention ring having a plurality of apertures, where the tubular flanged element may be constructed as tubular flanged element 114 shown in FIGS. 2A and 3A, and the contact retention ring may be constructed as contact retention ring 116 as shown in FIGS. 2A and 3A. Furthermore, conductive female sleeve contact 620 may include contact retention pins 624.

FIG. 7A illustrates a customizable panel mount male receptacle 700 in accordance with an embodiment mounted on a power side of a circuit. The customizable panel mount male receptacle 700 co-axially receives a male insulator cover body 712 assembled over a conductive male pin contact 720. The customizable panel mount male receptacle 700 engages with the customizable female plug 600 on the machine side.

FIG. 7B illustrates a customizable panel mount female receptacle 800 in accordance with another embodiment mounted on a power side of a circuit. The customizable panel mount female receptacle 800 co-axially receives a female insulator cover body 812 assembled over a conductive female sleeve contact 820. The customizable panel mount female receptacle 800 engages with the traditional male plug 500 on the power side.

TECHNICAL ADVANTAGES AND ECONOMICAL SIGNIFICANCE

The technical advancements offered by the connector assembly for a panel mounting system of the present disclosure include the realization of:

- a connector assembly having either customizable panel mount male or female receptacle,
- wherein the panel mount male and female receptacles can be customized based on customer requirements while still not requiring a large inventory of conductive contacts;
- a customizable panel mount receptacle that substantially reduces the inventory costs;
- a customizable panel mount receptacle that has modular configuration;
- a customizable panel mount receptacle that can quickly change configuration based on customer requirements;
- a customizable panel mount receptacle that is simple in construction and convenient to use;
- a customizable panel mount receptacle that is reliable;
- a customizable panel mount receptacle that eases inventory management; and
- a customizable panel mount receptacle that requires minimum maintenance.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

Any discussion of materials, devices or the like that has been included in this specification is solely for the purpose of providing a context for the disclosure. It is not to be taken as an admission that any or all of these matters form part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

We claim:

1. A customizable panel mount male receptacle comprising:

a male insulator body comprising:

a tubular flanged element;

a contact retention ring co-axially received within said tubular flanged element and comprising a plurality of apertures and a first set of engaging elements configured thereon; and a male insulator cover over-molded on said tubular flanged element;

a male contact assembly comprising:

a conductive male contact pin adapted to be removably and co-axially received inside said male insulator body; and a plurality of contact retention pins and a second set of engaging elements configured on said conductive male contact pin, wherein said contact retention pins are adapted to engage with said apertures configured on said contact retention ring and said second set of engaging elements are adapted to engage with said first set of engaging elements to facilitate interchangeable connection between different configurations of male insulator body and male contact assembly, wherein interchangeable connections between different configurations of said male insulator cover of male insulator body and said conductive male contact pin of said male contact assembly facilitates customization of said panel mount male receptacle based on requirement to reduce inventory.

2. The customizable panel mount male receptacle as claimed in claim 1 is adapted to be mounted on a power side of a circuit and adapted to be releasably connected to a cable mounted female plug assembly on a machine side.

3. The customizable panel mount male receptacle as claimed in claim 1, wherein said first set of engaging elements are receiving slots configured on inside surface of said contact retention ring of said male insulator body and said second set engaging elements are contact retention spring elements configured on contact retention spring mounted on said conductive male contact pin, wherein said contact retention spring elements are adapted to engage with said receiving slots.

4. The customizable panel mount male receptacle as claimed in claim 1, wherein said first set of engaging elements are U-slots configured on said contact retention ring of said male insulator body and said second set of engaging elements are spring biased pins configured on said conductive male contact pin, wherein said spring biased pins are adapted to engage with said U-slots.

5. The customizable panel mount male receptacle as claimed in claim 1, wherein said first set of engaging elements are first set of guide-ways configured on said contact retention ring of said male insulator body and said second set of engaging elements are second set of guide-ways configured on said conductive male contact pin that are complimentary to and adapted to engage with said first set of guide ways.

6. A customizable panel mount female receptacle comprising:

a female insulator body comprising:

a tubular flanged element;

a contact retention ring co-axially received within said tubular flanged element and comprising a plurality of apertures and a first set of engaging elements configured thereon; and a female insulator cover over-molded on said tubular flanged element;

a female contact assembly comprising:

a conductive female sleeve contact adapted to be removably and co-axially received inside said female insulator body; and a plurality of contact retention pins and a second set of engaging elements configured on said conductive female contact sleeve, wherein said contact retention pins are adapted to engage with said apertures configured on said contact retention ring and said second set of engaging elements are adapted to engage with said first set of engaging elements to facilitate interchangeable connection between different configurations of female insulator body and female contact assembly, wherein interchangeable connections between different configurations of said female insulator cover of said female insulator body and said conductive female contact sleeve of said female contact assembly facilitate customization of said panel mount female receptacle based on requirement to reduce inventory.

7. The customizable panel mount female receptacle as claimed in claim 6 is adapted to be mounted on a power side of a circuit and adapted to be releasably connected to a cable mounted male plug assembly on a machine side.

8. The customizable female panel mount receptacle as claimed in claim 6 is mounted on either one of machine and motor side of the circuit for connection to cable mounted male plug assembly.

9. The customizable panel mount female receptacle as claimed in claim 6, wherein said first set of engaging elements are receiving slots configured on inside surface of said contact retention ring of said female insulator body and said second set of engaging elements are contact retention spring elements configured on contact retention spring mounted on said conductive female contact sleeve, wherein said contact retention spring elements are adapted to engage with said receiving slots.

* * * * *